US011980255B2

(12) United States Patent
Sanchez et al.

(10) Patent No.: US 11,980,255 B2
(45) Date of Patent: May 14, 2024

(54) CLEAT ASSEMBLY

(71) Applicant: New York Society for the Relief of the Ruptured and Crippled, maintaining the Hospital for Special Surgery, New York, NY (US)

(72) Inventors: Hernan Sanchez, Carmel, NY (US); Laurence Piturro, Mount Kisco, NY (US); Bo Li, Hamilton, NJ (US); Howard Hillstom, New York, NY (US); Andrew Kraszewski, New York, NY (US); Mark Drakos, Cold Spring Harbor, NY (US)

(73) Assignee: New York Society for the Relief of the Ruptured and Crippled, maintaining the Hospital for Special Surgery, New York, NY (US)

( * ) Notice: Subject to any disclaimer, the term of this patent is extended or adjusted under 35 U.S.C. 154(b) by 0 days.

(21) Appl. No.: 17/457,293

(22) Filed: Dec. 2, 2021

(65) Prior Publication Data

US 2022/0087369 A1 Mar. 24, 2022

Related U.S. Application Data

(62) Division of application No. 16/811,847, filed on Mar. 6, 2020, now Pat. No. 11,213,101.
(Continued)

(51) Int. Cl.
*A43C 15/16* (2006.01)

(52) U.S. Cl.
CPC ..... *A43C 15/167* (2013.01); *A43C 15/161* (2013.01); *A43C 15/168* (2013.01)

(58) Field of Classification Search
CPC ..... A43C 15/16; A43C 15/167; A43C 15/168
(Continued)

(56) References Cited

U.S. PATENT DOCUMENTS 2,911,738 A * 11/1959 Clerke ..... A43C 15/161 36/134
4,146,979 A 4/1979 Fabbrie
(Continued)

FOREIGN PATENT DOCUMENTS

JP 59141901 A 8/1984
JP 6237803 A 3/1995
(Continued)

OTHER PUBLICATIONS

Notice of Reasons for Refusal in counterpart Japanese Patent Application No. 2021-552727, dated Aug. 19, 2022.
(Continued)

*Primary Examiner* — Ted Kavanaugh
(74) *Attorney, Agent, or Firm* — Kim IP Law Group LLC

(57) ABSTRACT

A cleat assembly for a shoe comprising an anchor for anchoring to the shoe, a cleat, a first biasing member circumscribing the anchor and engaged with the cleat, and a second biasing member biasing the first biasing member. The second biasing member can directly engage the first biasing member or a bushing that circumscribes the anchor. So constructed, the cleat assembly provides multiple degrees of freedom. That is, the cleat assembly provides effective axial shock absorbance coupled with 360° tilting of the cleat for enhancing a user's ability to suddenly change direction when wearing a shoe equipped with the cleat assembly, thereby minimizing stress and impact on muscles, joints and ligaments and enhancing the performance of athletes wearing such shoes.

24 Claims, 19 Drawing Sheets

Related U.S. Application Data

(60) Provisional application No. 62/815,819, filed on Mar. 8, 2019.

(58) Field of Classification Search
USPC ..... 36/134
See application file for complete search history.

(56) References Cited

U.S. PATENT DOCUMENTS 4,470,207 A * 9/1984 Bente ..... A43C 15/167 36/134
5,361,518 A * 11/1994 Sussmann ..... A43C 15/167 36/134
5,377,431 A * 1/1995 Walker ..... A43C 15/162 36/134
6,442,872 B1 * 9/2002 Liao ..... A43C 15/161 36/114
2014/0310995 A1 * 10/2014 Campari ..... A43C 15/168 36/134
2016/0021981 A1 * 1/2016 Sanchez ..... A43B 13/26 36/134

FOREIGN PATENT DOCUMENTS

JP 8294404 A 11/1996
JP 10201502 A2 8/1998
JP 2014533529 A 12/2014
JP 2021514684 A2 6/2021
WO 2008138314 A1 11/2008

OTHER PUBLICATIONS

Search Report by Registered Search Organization in counterpart Japanese Patent Application No. 2021-552727, dated Aug. 26, 2022.
Notice of Reasons for Refusal in counterpart Japanese Patent Application No. 2021-552727, mailed Mar. 5, 2023.

* cited by examiner

CLEAT ASSEMBLY

CROSS-REFERENCE TO RELATED APPLICATION

This application is a divisional of U.S. patent application Ser. No. 16/811,847, filed Mar. 6, 2020, and entitled "Cleat Assembly" which claims the benefit under 35 U.S.C. § 119(e) to U.S. Provisional Application No. 62/815,819, filed Mar. 8, 2019, and entitled "Dual Spring Cleat," the entire disclosures of which are hereby incorporated by reference for all purposes.

BACKGROUND OF THE DISCLOSURE

The exemplary embodiments of present invention relate generally to a cleat assembly for a shoe and, more specifically, to a cleat assembly having multiple biasing members to permit movement of the cleat about multiple degrees of freedom.

Shoe cleat assemblies that permit axial movement of the cleat with respect to the shoe are known. Such assemblies enable the cleat to move along a longitudinal axis of the cleat. However, such assemblies are limited to only movement along a single degree of freedom.

BRIEF SUMMARY OF THE DISCLOSURE

In accordance with an exemplary embodiment there is provided a cleat assembly for a shoe comprising an anchor for anchoring to the shoe, a cleat, a first biasing member circumscribing the anchor and engaged with the cleat, and a second biasing member biasing the first biasing member.

According to an aspect, the anchor comprises a main body, a fastener extending from a proximal end of the main body, and a substantially planar bottom about a distal end of the main body, wherein the substantially planar bottom extends radially outwardly from the main body.

According to an aspect, the substantially planar bottom is completely housed within the cleat. According to an aspect, the cleat circumscribes the anchor, the first biasing member, and the second biasing member. According to an aspect, the cleat includes an inner race for receiving the first biasing member. According to an aspect, the first biasing member is press-fittingly engaged with the inner race.

According to an aspect, the cleat assembly further comprises a bushing circumscribing the anchor. According to an aspect, the bushing slidingly engages the anchor. According to an aspect, the first biasing member circumscribes the bushing. According to an aspect, the first biasing member is connected to the bushing.

According to an aspect, the first biasing member is an annular biasing member. According to an aspect, the first biasing member is completely housed within the cleat. According to an aspect, the first biasing member has a bending stiffness coefficient of about 0.67 in-lbs/deg to 1.33 in-lbs/deg. According to an aspect, the first biasing member provides a bending force independent of the second biasing member providing a biasing force along an axial direction of the anchor.

According to an aspect, the second biasing member directly engages the first biasing member. According to an aspect, the second biasing member directly engages the bushing. According to an aspect, the second biasing member circumscribes the anchor. According to an aspect, the second biasing member has a spring constant from about 571 lbs/in to 1143 lbs/in. According to an aspect, the anchor, the first biasing member, and the second biasing member are housed within the cleat.

According to an aspect, the cleat assembly further comprises a shroud extending from the cleat. According to an aspect, the cleat assembly further comprises a deformable member between the cleat and a fastener of the anchor for preventing or expelling debris away from the cleat assembly. According to an aspect, the deformable member is a shroud, an expandable elastomer, a bellows, and/or a seal.

According to an aspect, there is provided a shoe having a sole and a cleat assembly secured to the sole. The cleat assembly comprises an anchor for anchoring to the shoe, a cleat, a first biasing member circumscribing the anchor and engaged with the cleat, and a second biasing member biasing the first biasing member.

According to an aspect, the anchor comprises a retaining post, and a fastener pivotably connected to a proximal end of the retaining post. According to an aspect, the fastener is connected to the retaining post via a ball and socket joint. According to an aspect, the first biasing member circumscribes the fastener.

According to an aspect, the retaining post includes an annular flange. According to an aspect, the retaining post includes a post and the second biasing member circumscribes the post. According to an aspect, the second biasing member is completely housed within the cleat. According to an aspect, the cleat includes an inner race for receiving a detent on the retaining post.

According to another aspect, the anchor comprises a retaining post and a fastener pivotably connected to a proximal end of the retaining post. According to another aspect, the fastener is connected to the retaining post via a ball and socket joint.

According to another aspect, the first biasing member circumscribes the fastener. According to another aspect, the second biasing member is completely housed within the cleat.

According to another aspect, the retaining post includes an annular flange and a post, wherein the second biasing member circumscribes the post. According to another aspect, the cleat includes an inner race for receiving a detent on the retaining post.

So constructed, the cleat assembly provides effective axial shock absorbance coupled with cleat rotatability and 360° tilting of the cleat for enhancing a user's ability to suddenly and easily change direction when wearing a shoe equipped with the cleat assembly, thereby minimizing stress and impact on muscles, joints and ligaments and enhancing the performance of athletes wearing such shoes. In addition, the cleat assembly enhances rotational or translational release to minimize the occurrence of soft tissue (e.g., ACL or meniscus tears) injuries. It is well known that approximately 50% of individuals with soft tissue injuries will go on to develop osteoarthritis.

Other features and advantages of the subject disclosure will be apparent from the following more detail description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

DETAILED DESCRIPTION OF THE DISCLOSURE

Figure 1:
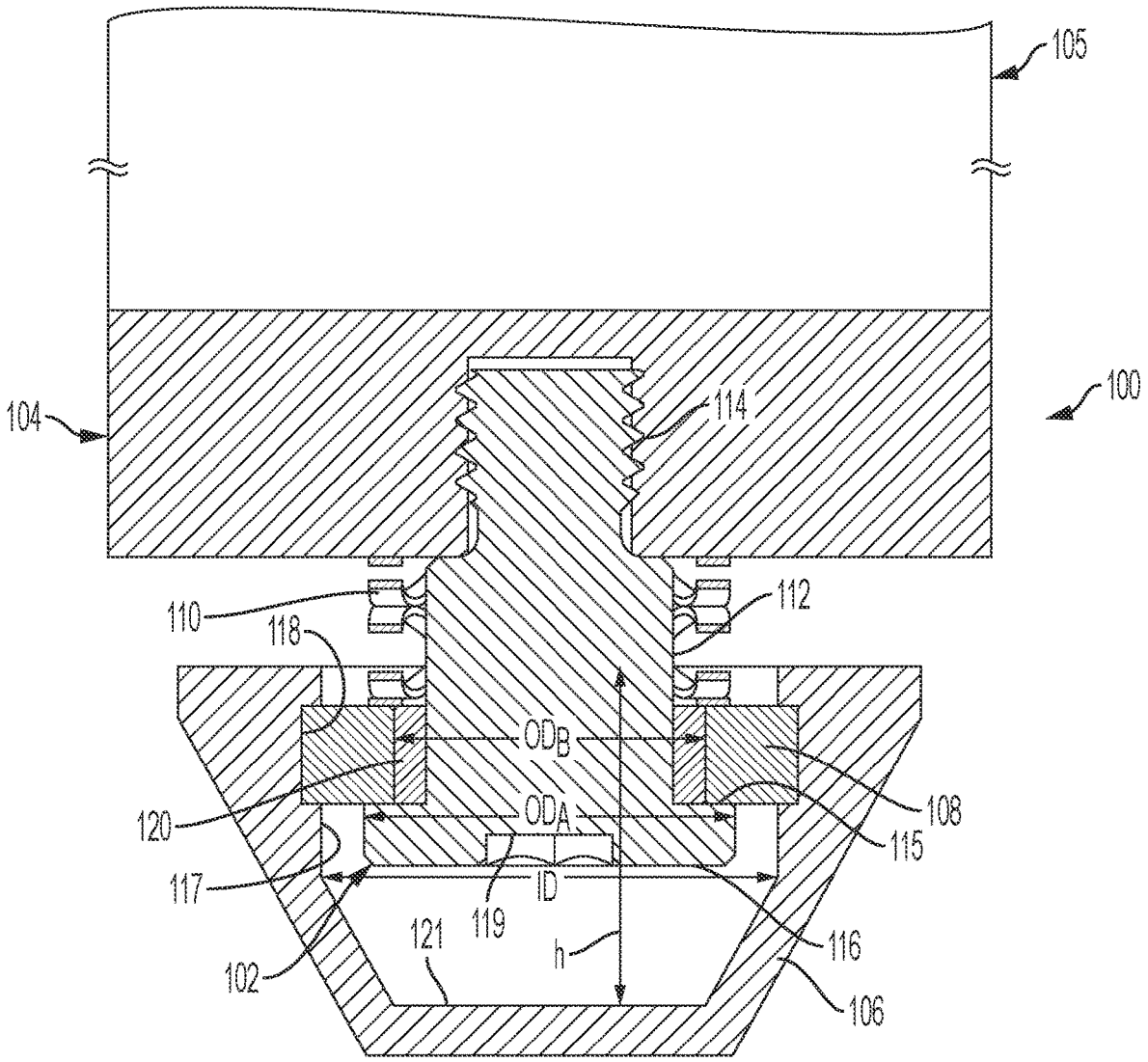
FIG. 1 is a side cross-sectional view of a cleat assembly in accordance with an exemplary embodiment of the subject disclosure.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Referring now to the drawings, FIG. 1 illustrates a cleat assembly 100 in accordance with an exemplary embodiment of the present disclosure. The cleat assembly 100 includes an anchor 102 for anchoring to a sole 104 of a shoe 105, a cleat 106, a first biasing member 108, and a second biasing member 110. While FIG. 1 depicts a single cleat assembly secured to the sole of a shoe, it is understood that a plurality of such cleat assemblies may be secured to the shoe sole.

Figure 3A:
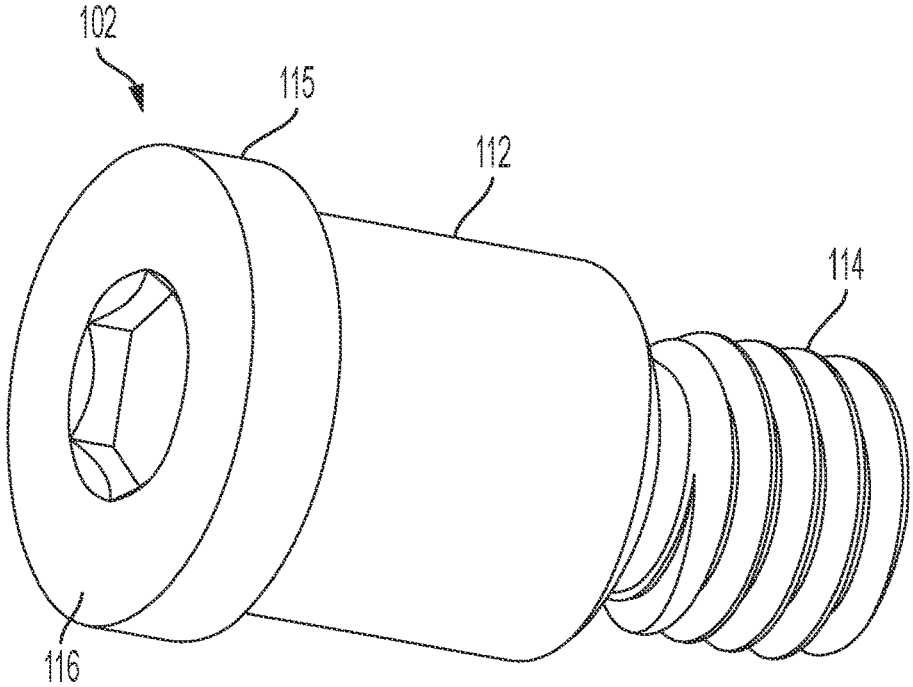
FIG. 3A is a top perspective view of an anchor applicable to either of the cleat assemblies of FIGS. 1 and 2.
Figure 3B:
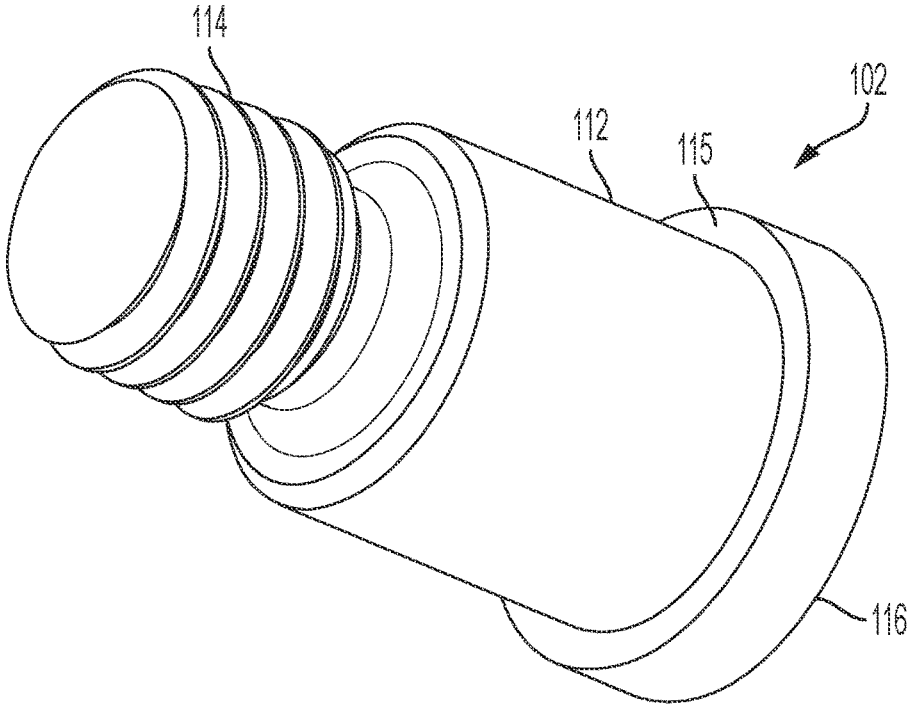
FIG. 3B is a bottom perspective view of the anchor of FIG. 3A.

The anchor 102 is configured as best shown in FIGS. 1, 3A and 3B. The anchor includes a main body 112, a fastener 114 extending from a proximal end of the main body, and a substantially planar bottom 116 about a distal end of the main body. The substantially planar bottom extends radially outwardly from the main body 112 to define a flange 115. Moreover, as shown in FIG. 1, the substantially planar bottom is completely housed within the cleat 106. The fastener 114 extends proximally from the main body. The main body 112 of the anchor 102 is cylindrical in shape (and can be of a longitudinal cross-section of other shapes e.g.

square) and the fastener 114 is smaller in diameter than the main body. In addition the main body has a length substantially the same of slightly smaller than a longitudinal length of the cleat. In the present exemplary embodiment, the fastener is a threaded fastener e.g., for threadedly engaging corresponding threads provided in the sole 104 of the shoe. The main body 112 can have a recess 119 adapted for receiving a tool such as a wrench or the like for turning the fastener into and out of the sole of the shoe. While the present exemplary embodiment of the fastener is threaded, other types of fasteners applicable for the intended purpose are permitted, e.g., J-lock or friction-fit fasteners, and the like.

Figure 4A:
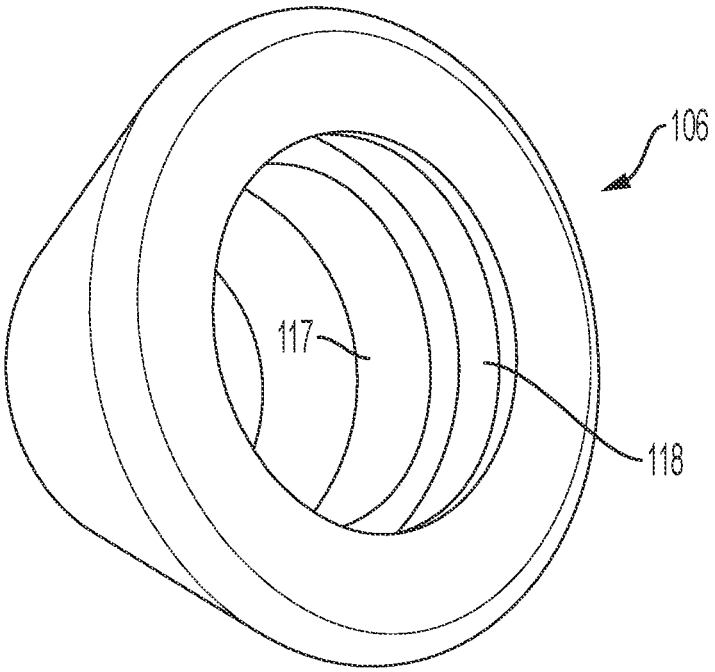
FIG. 4A is a bottom perspective view of a cleat of either of the cleat assemblies of FIGS. 1 and 2.
Figure 4B:
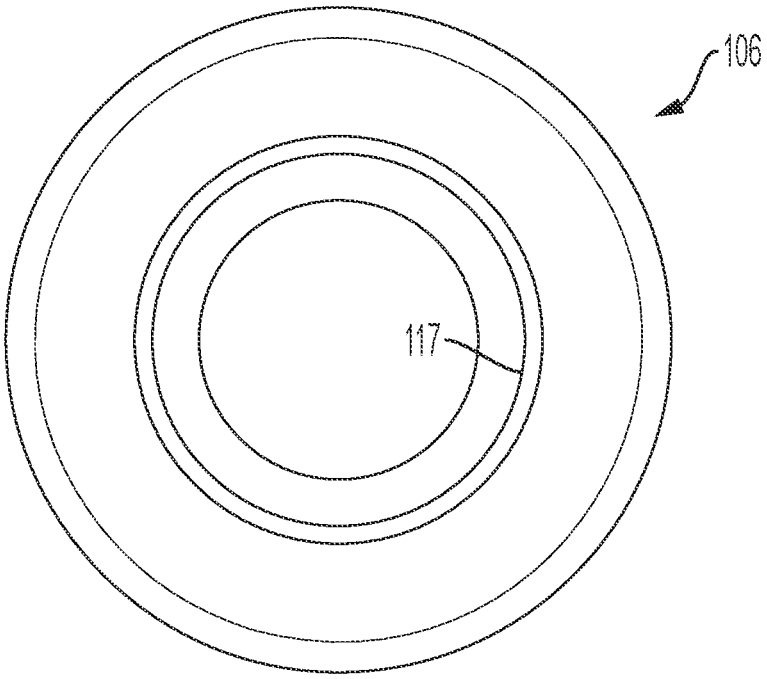
FIG. 4B is a bottom view of the cleat of FIG. 4A.

The cleat 106 is configured as best shown in FIGS. 1, 4A and 4B. The cleat is shaped substantially as a frustoconical cone having a substantially hollow interior. The interior of the cleat includes a cylindrical side wall 117. According to an aspect, the cleat includes an inner race 118 within the cylindrical side wall 117 for receiving the first biasing member. Referring to FIG. 1, the cleat has an inner diameter "ID", e.g., defined by the cylindrical side wall 117, larger than a maximum outer diameter "$OD_A$" of the substantially planar bottom of the anchor 102. The cleat has a hollow interior having a height "h". When axial force is applied to the bottom of the cleat 106, the height of the hollow interior has sufficient clearance to permit the top of the cleat 106 to mate with the shoe sole 104 as a bushing 120, described below, slides upwardly along the main body 112 of the anchor and compresses the second biasing member 110.

The cleat assembly further comprises the bushing 120, as best shown in FIG. 1. The bushing is preferably configured as an annular bushing and may be made e.g., from a metal, a rigid plastic, or the like. The bushing may alternatively include bearings to facilitate rotational engagement with the anchor 102. As shown in FIG. 1, for example, the bushing 120 circumscribes the anchor 102 and is slidingly engaged with the anchor. That is, the bushing has the same or a slightly larger diameter than the main body 112 of the anchor 102 whereby the busing is capable of sliding along a longitudinal length of the anchor. The bushing 120 has a maximum outer diameter "$OD_B$" that is less than the maximum outer diameter "$OD_A$" of the substantially planar bottom of anchor 102.

Figure 5:
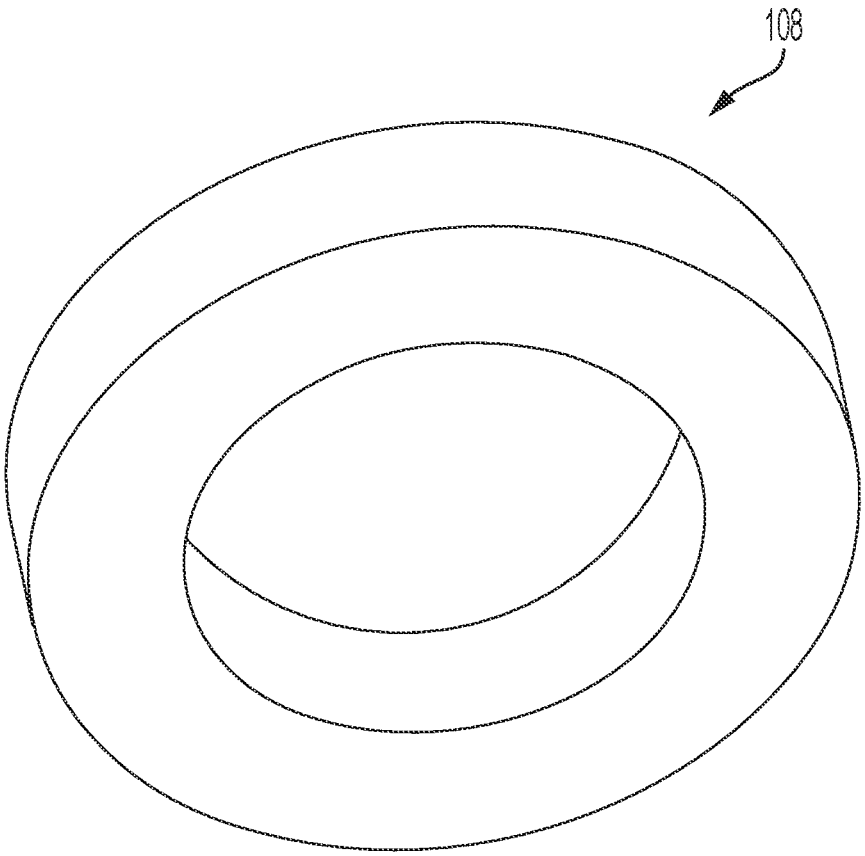
FIG. 5 is a perspective view of a first biasing member of either of the cleat assemblies of FIGS. 1 and 2.

The first biasing member 108 circumscribes the bushing 120 and is engaged with the cleat. The first biasing member can be press-fittingly engaged with the inner race 118 to securely position the first biasing member with respect to the cleat. According to an aspect, the first biasing member can be connected to the bushing via a friction fit, adhesives or other suitable connector mechanisms. As best seen in FIG. 5, the first biasing member is an annular biasing member. According to an aspect, the first biasing member can be formed from, e.g., an elastomer or other resilient material, and have a bending stiffness coefficient of about 0.67 in-lbs/deg to 1.33 in-lbs/deg, including 0.50, 0.55, 0.60, 0.65, 0.70, 0.75, 0.80, 0.85, 0.90, 0.95, 1.00, 1.10, 1.20, 1.30, 1.40, 1.50, 1.60, 1.70, 1.80 and 1.90 in-lbs/deg. The first biasing member is completely housed within the cleat 106. The first biasing member provides a bending force independent of the second biasing member 110 providing a biasing force along an axial direction of the anchor 102. This torque versus angle relationship may be linear or non-linear.

In the illustrated embodiment of FIG. 1, the second biasing member 110 engages the first biasing member 108 and/or the bushing 120 and, more particularly, directly engages the first biasing member and/or bushing. The second biasing member circumscribes the anchor 102 e.g., about its main body 112. The second biasing member can be a spring, or appropriately configured elastomer, polymeric member, or a linear biasing member, or a non-linear biasing member. According to an aspect, the second biasing member has a spring constant from about 571 lbs/in to 1143 lbs/in, including 475, 500, 525, 550, 575, 600, 625, 650, 675, 700, 750, 800, 850, 900, 950, 1000, 1050, 1100, 1150, 1200, 1250 and 1300 lbs/in. The cleat 106 circumscribes the anchor 102, the first biasing member 108, and the second biasing member 110. That is, the anchor, the first biasing member and the second biasing member are housed within the cleat.

Figure 2:
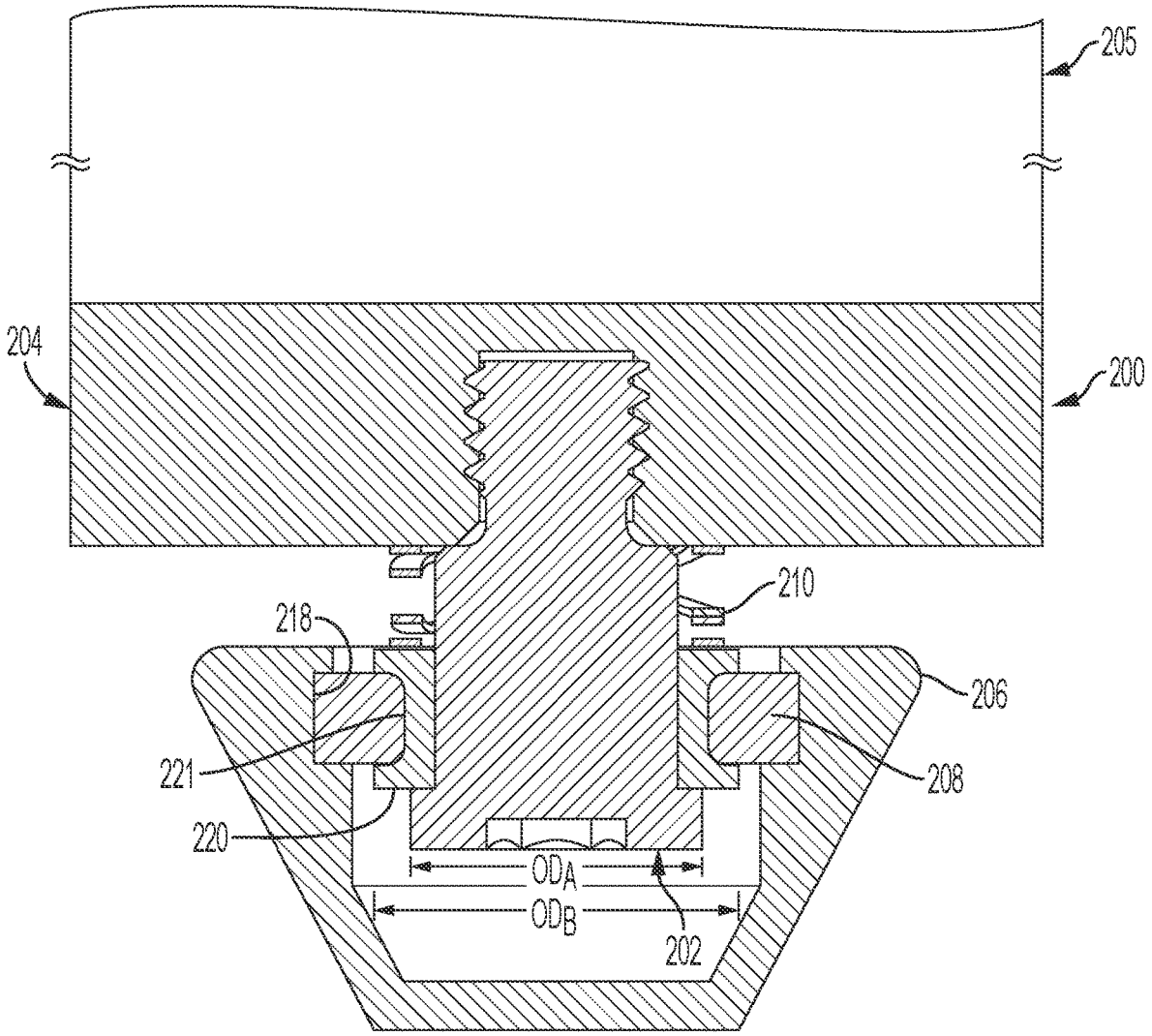
FIG. 2 is a side cross-sectional view of a cleat assembly in accordance with another exemplary embodiment of the subject disclosure.

Referring to FIG. 2, there is shown a cleat assembly 200 constructed in accordance with another exemplary embodiment of the subject disclosure. Cleat assembly 200 is constructed similar to cleat assembly 100. Accordingly, only those aspects of the cleat assembly 200 that depart materially in structure and/or function from their counterparts in cleat assembly 100, or are otherwise necessary for a proper understanding of the subject disclosure, will be discussed in detail.

As shown in FIG. 2, the bushing 220 has a maximum outer diameter $OD_B$ that is greater than the maximum outer diameter $OD_A$ of the anchor 202, such as the substantially planar bottom.

Figure 6:
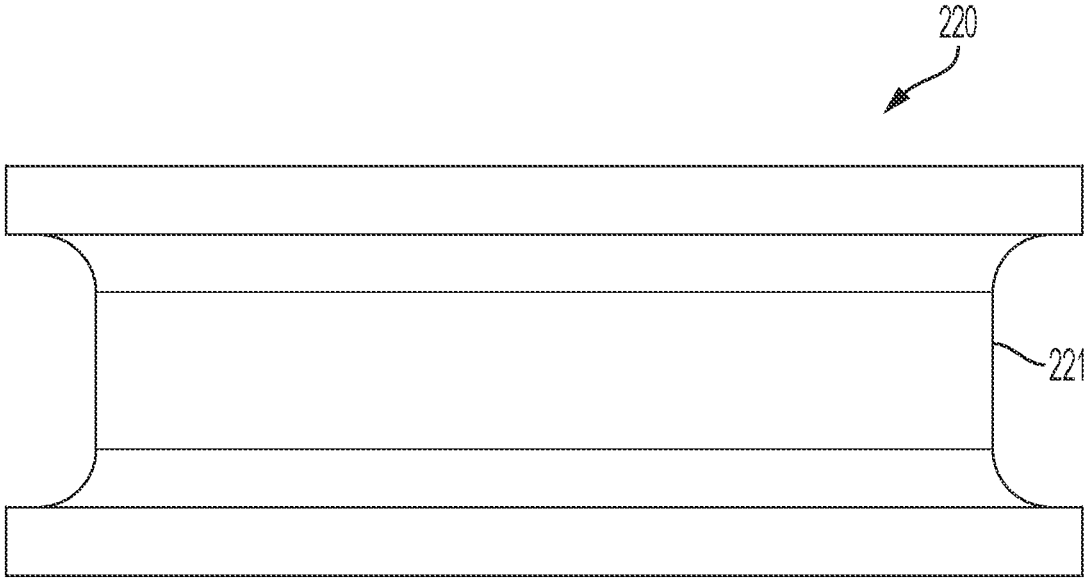
FIG. 6 is a side view of a bushing of the cleat assembly of FIG. 2.

In the illustrated embodiment of FIGS. 2 and 6, the bushing 220 includes an inner race 221. The inner race faces opposite the inner race 218 of the cleat 206 (FIG. 2). The inner races 218 and 221 serve to retain the first biasing member 208 in the cleat 206. The first biasing member can be press-fittingly engaged with the first and second races 218, 221 and/or attached via adhesive, welding and the like. In addition, the second biasing member 210 engages the bushing 220 and the second biasing member and, more particularly, directly engages the bushing 220.

Figure 7:
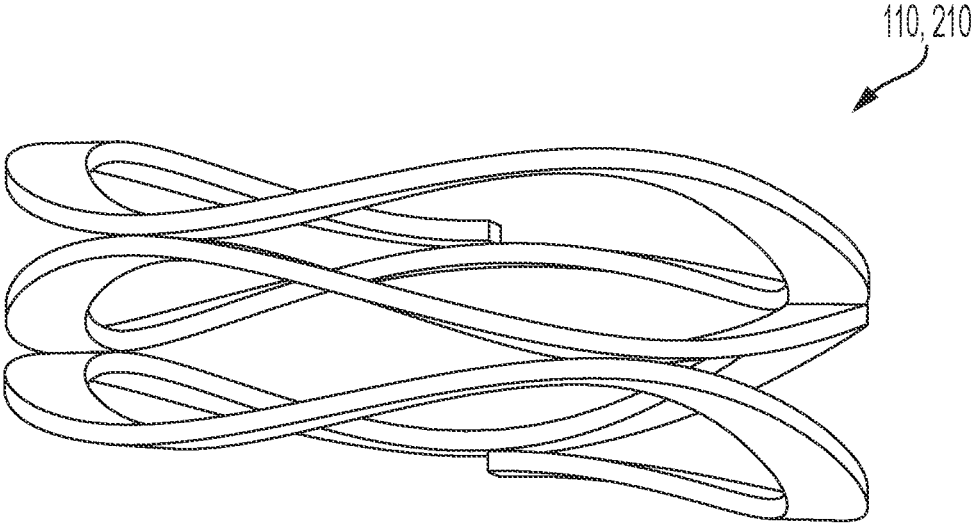
FIG. 7 is a side view of a second biasing member of either of the cleat assemblies of FIGS. 1 and 2.
Figure 8A:
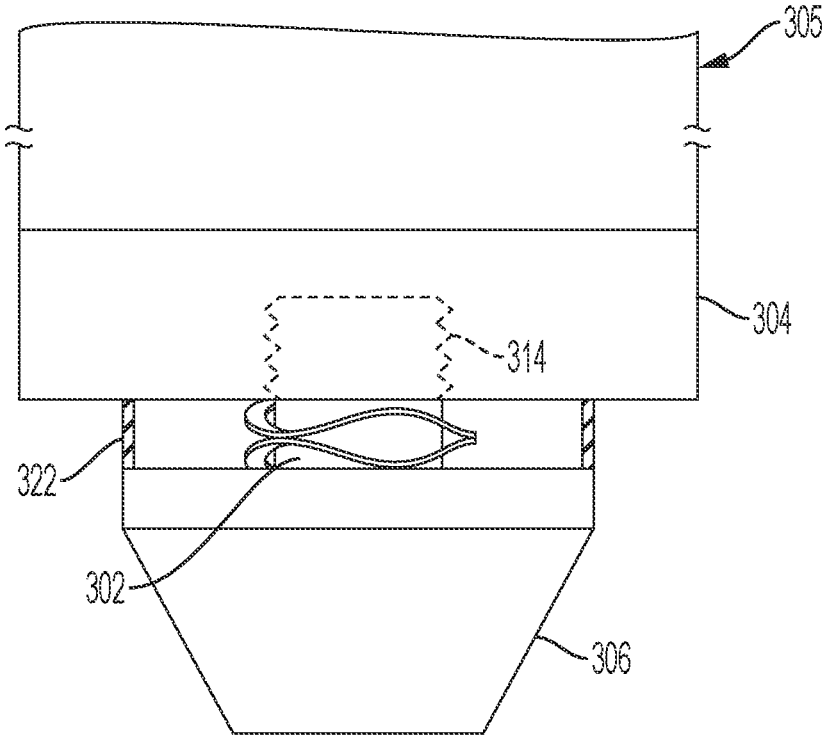
FIG. 8A is a side view of a cleat assembly in accordance with another exemplary embodiment of the subject disclosure.
Figure 8B:
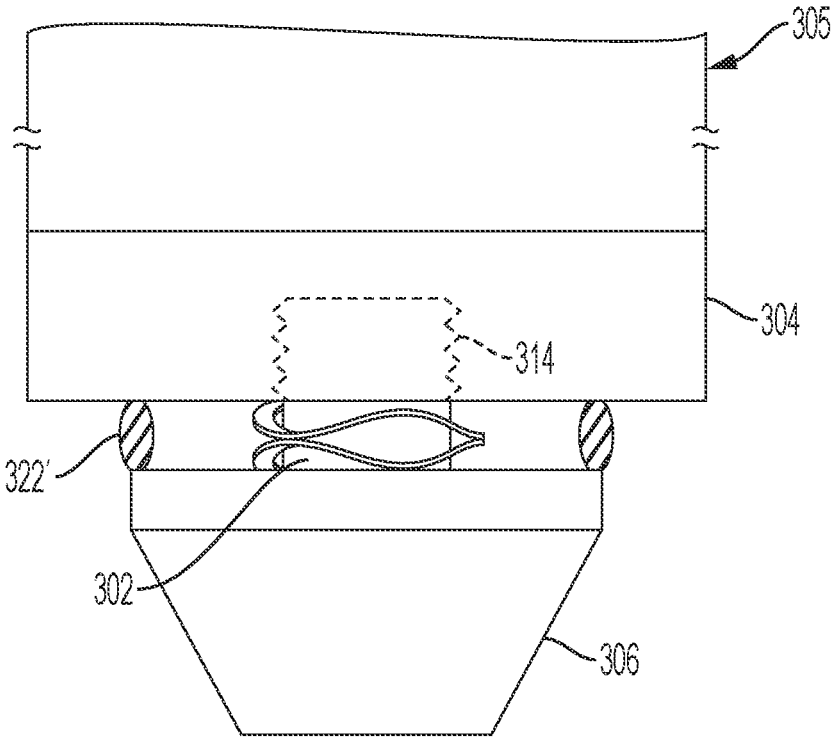
FIG. 8B is a side view of a cleat assembly in accordance with another exemplary embodiment of the subject disclosure.
Figure 8C:
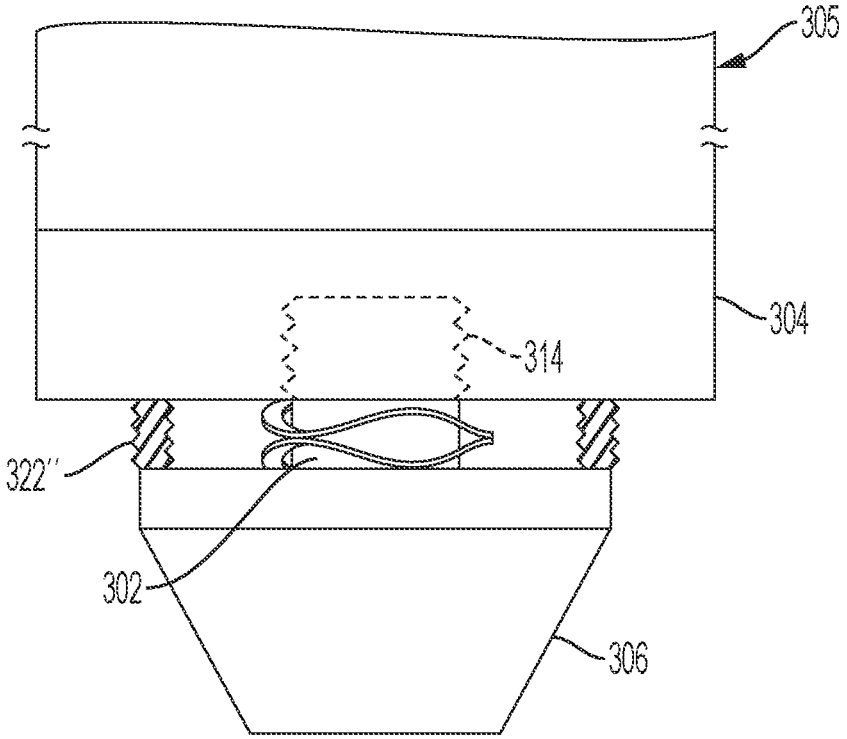
FIG. 8C is a side view of a cleat assembly in accordance with another exemplary embodiment of the subject disclosure.
Figure 8D:
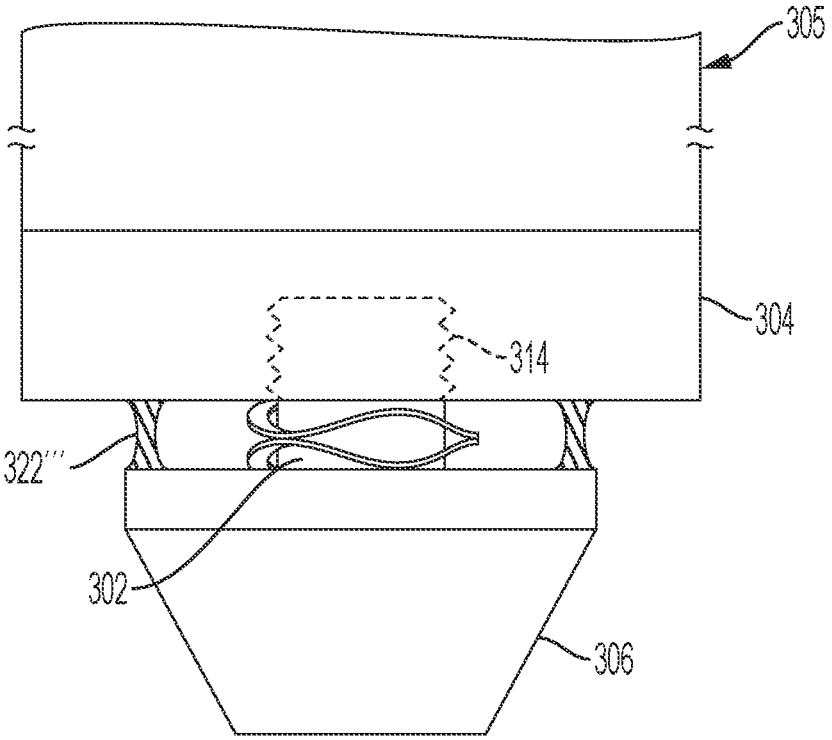
FIG. 8D is a side view of a cleat assembly in accordance with another exemplary embodiment of the subject disclosure.

As shown in FIG. 7, the second biasing member 110, 210 is illustrated as a compression spring. In the illustrated embodiment, the second biasing member 110, 210 is a wave spring, although as noted above it may assume other forms including, without limitation, an elastomer, a polymeric member, a linear biasing member, or a non-linear biasing member, which may be annular in shape or non-annular, e.g., linear, square, hexagonal, and the like.

Referring to FIGS. 8A-8D, there is shown a cleat assembly 300 constructed in accordance with another exemplary embodiment of the subject disclosure. Cleat assembly 300 is constructed similar to cleat assemblies 100 and 200. Accordingly, only those aspects of the cleat assembly 300 that depart materially in structure and/or function from their counterparts in cleat assemblies 100 and 200, or are otherwise necessary for a proper understanding of the subject disclosure, will be discussed in detail.

Cleat assembly 300 comprises a deformable member between the cleat 306 and a fastener 314 of the anchor 302 for preventing or expelling debris away from the cleat assembly such as the area between the cleat and the shoe. The deformable member can be a shroud 322 (FIG. 8A), an expandable elastomer 322' (FIG. 8B), a bellows 322" (FIG. 8C) and/or a seal 322''' (FIG. 8D) that e.g. circumscribes or completely circumscribes the cleat and extends from the cleat. According to an aspect, the deformable member comprises an annular shroud extending from the cleat 306.

Figure 9:
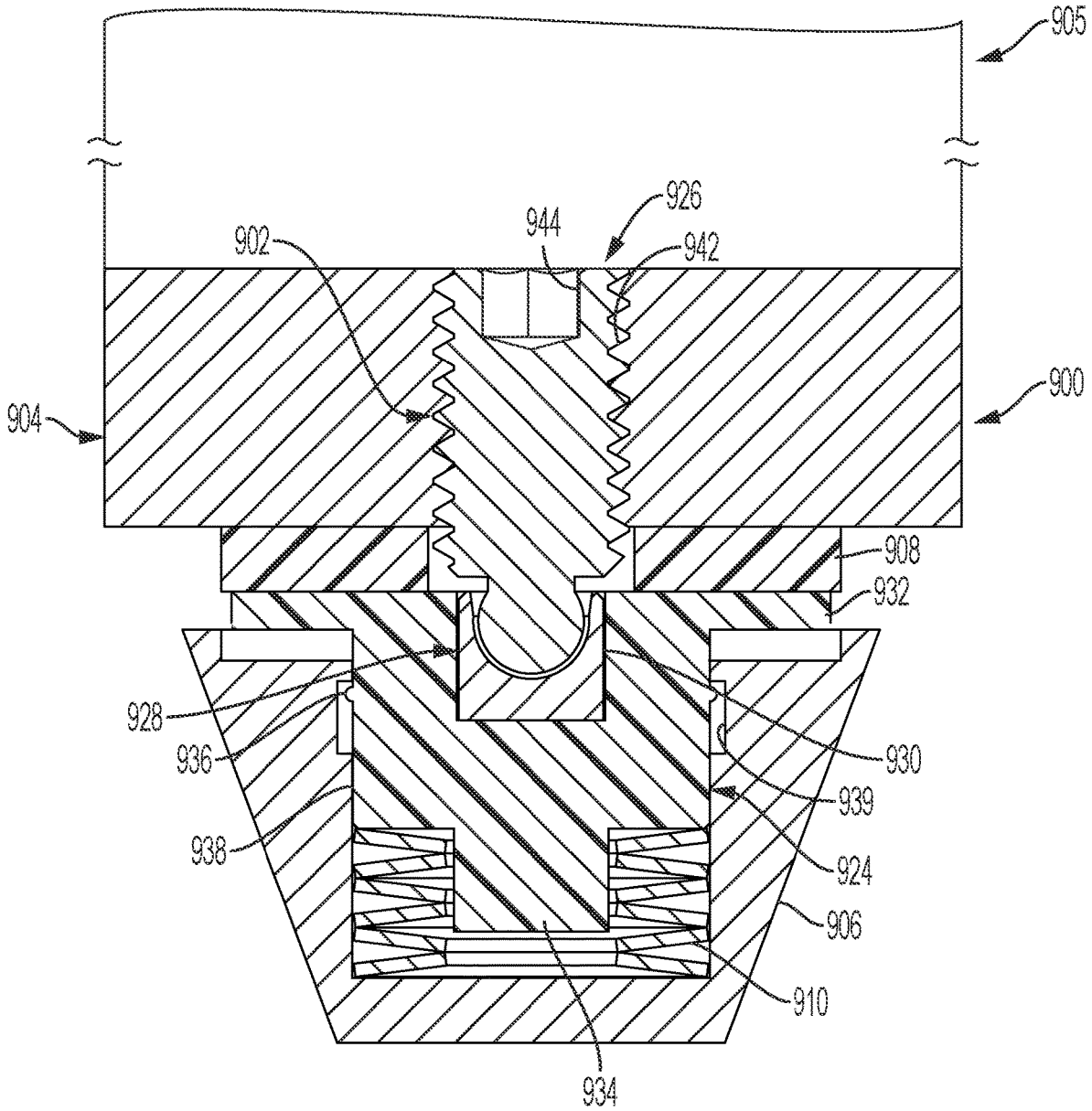
FIG. 9 is a side cross-sectional view of a cleat assembly in accordance with another exemplary embodiment of the subject disclosure with the cleat thereof in an undeflected state.
Figure 10:
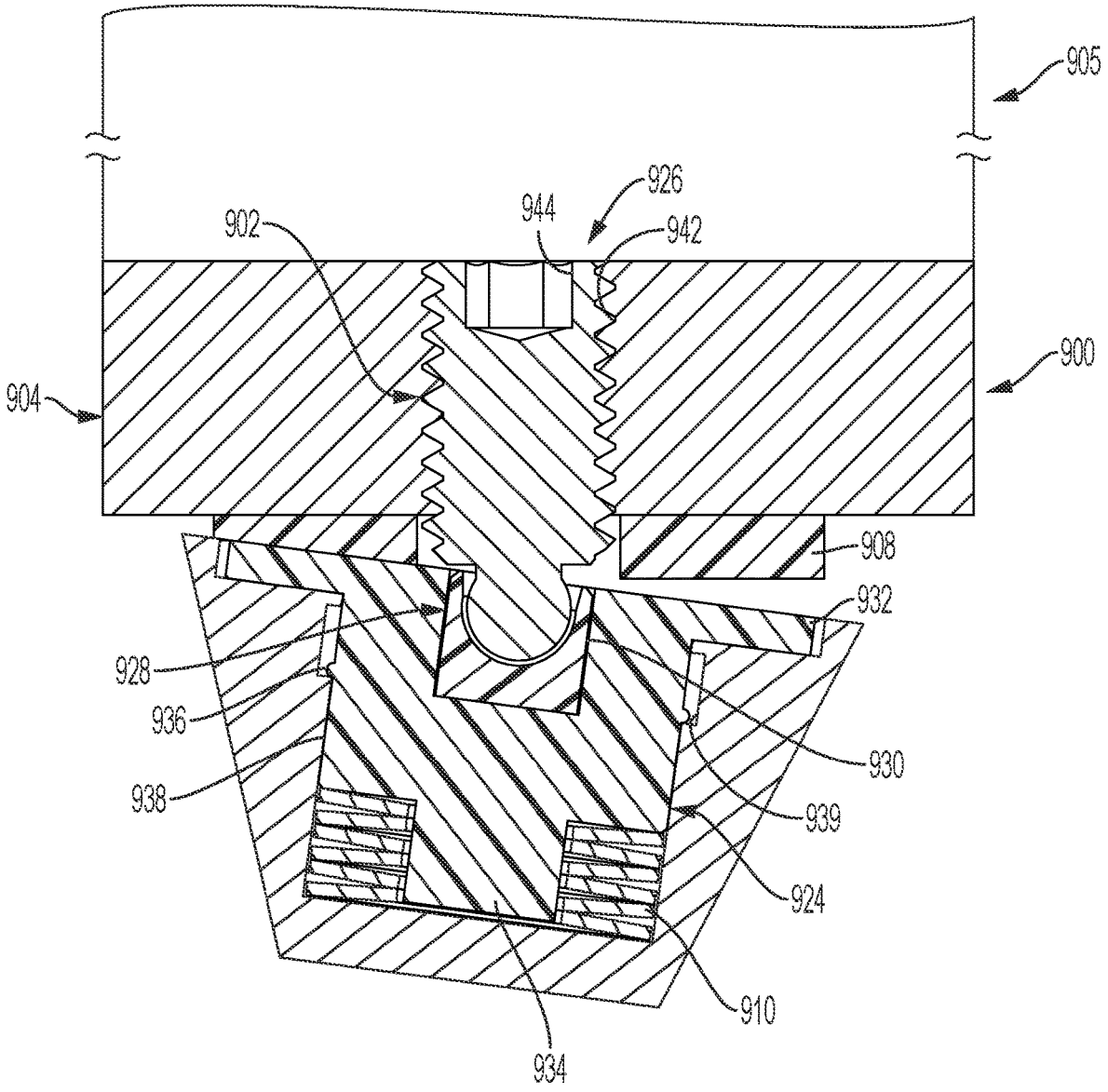
FIG. 10 is a side cross-sectional view of the cleat assembly of FIG. 9 with the cleat thereof in a deflected state.

Referring to FIGS. 9 and 10, there is shown a cleat assembly 900 constructed in accordance with another exemplary embodiment of the subject disclosure. The cleat assembly 900 includes an anchor 902 for anchoring to a sole 904 of a shoe 905, a cleat 906, a first biasing member 908, and a second biasing member 910. While FIGS. 9 and 10 depict a single cleat assembly secured to the sole of a shoe, it is understood that a plurality of such cleat assemblies may be secured to the shoe sole.

The anchor 902 comprises a retaining post 924 and a fastener 926 pivotably connected to a proximal end of the retaining post. According to an aspect, the fastener 926 is connected to the retaining post 924 via a ball and socket joint 928 seated in a recess 930 provided in a proximal end of the retaining post. The ball and socket joint securely connects the retaining post to the fastener. At its proximal end the retaining post includes an annular flange 932 constructed and arranged to contact the first biasing member 908, as described in greater detail below. According to an aspect, the annular flange has an outer periphery substantially corresponding in size and shape to an outer periphery of the first biasing member. At its distal end, the retaining post includes a post 934. The retaining post further includes a detent 936 (FIGS. 9, 10, 14A and 14B) in the form of an annular bead formed on a circumferential wall 938 of the retaining post.

Figure 12:
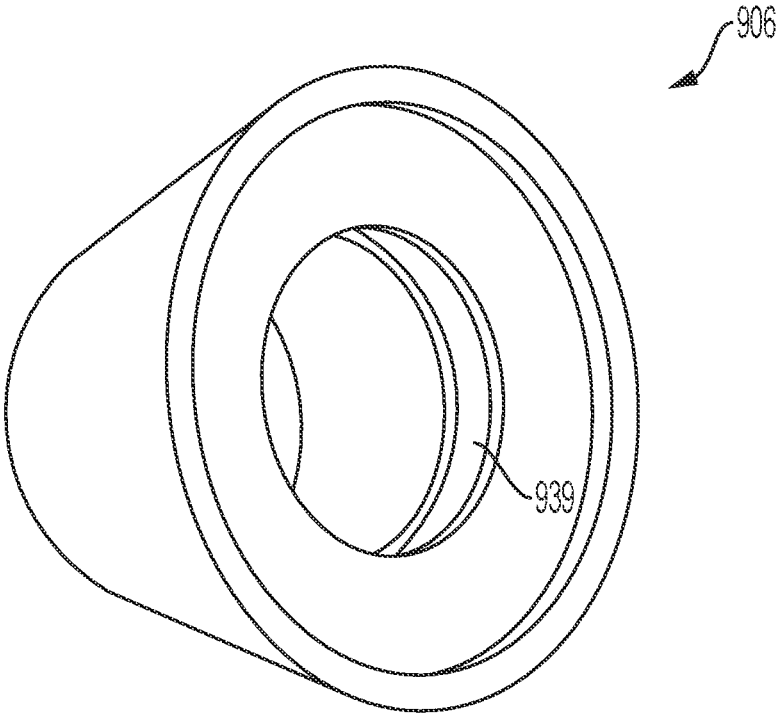
FIG. 12 is a bottom perspective view of a cleat of the cleat assembly of FIG. 9.

As shown in FIGS. 9, 10 and 12, the cleat 906 includes an inner race 939 for receiving the detent 936 on the retaining post 924. The inner race is sized sufficiently to allow axial movement of the cleat relative to the retaining post e.g., to allow the detent 936 to move in a longitudinal axial direction of the cleat.

Figure 11A:
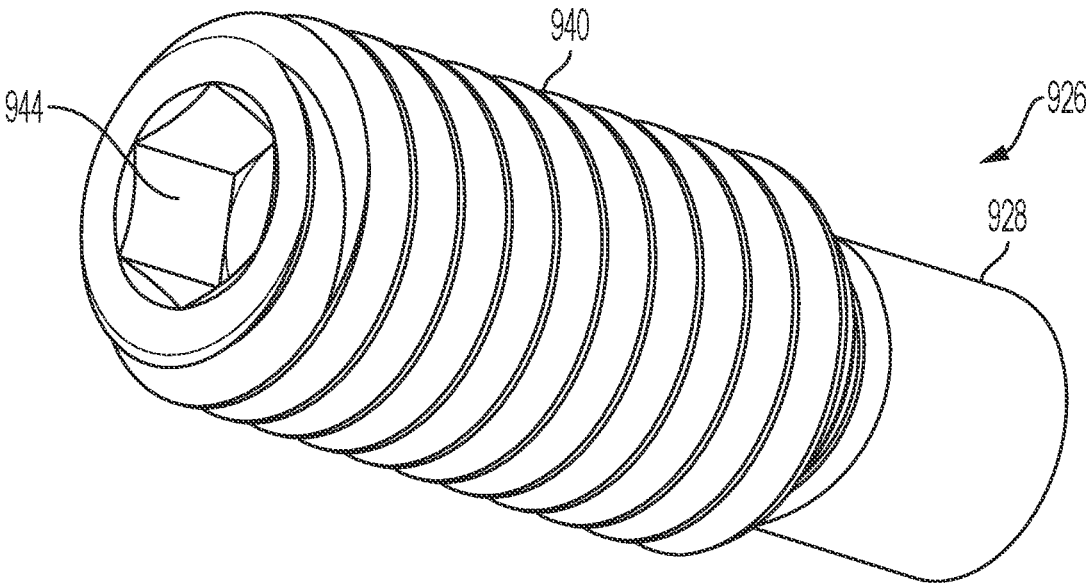
FIG. 11A is a top perspective view of a fastener of an anchor of the cleat assembly of FIG. 9.
Figure 11B:
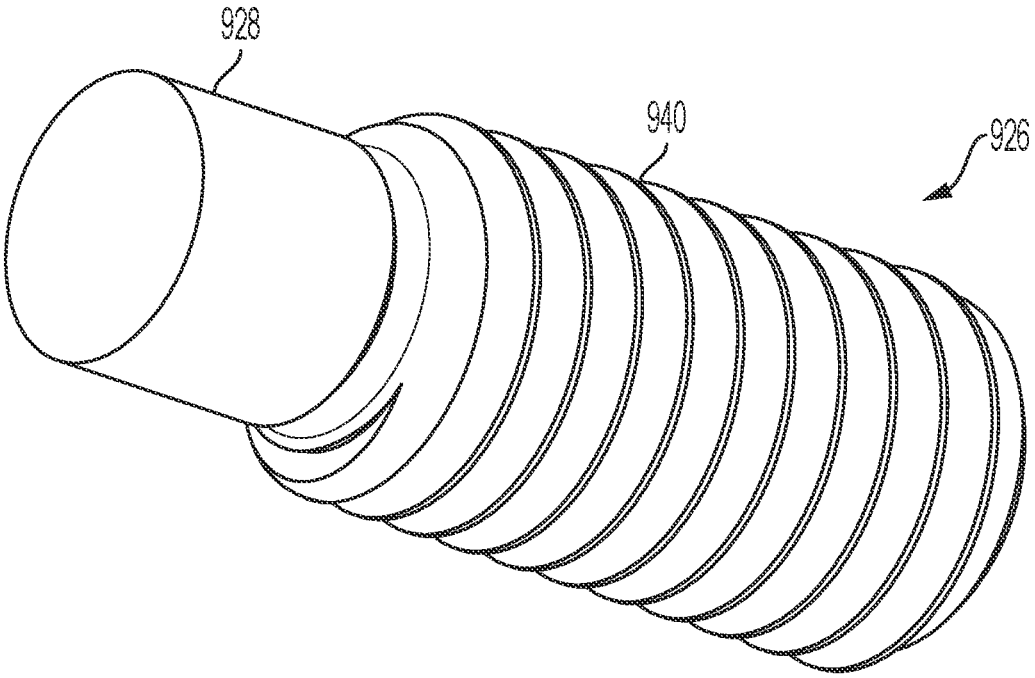
FIG. 11B is a bottom perspective view of the fastener of FIG. 11A.

The fastener 926 is best shown in FIGS. 11A and 11B. According to an aspect, the fastener 926 includes external threading 940 for threadedly engaging corresponding threading 942 (FIGS. 9 and 10) provided in the shoe sole 904. At its proximal end the fastener may be provided with a socket 944 that may be engaged by a suitable unillustrated tool such as a wrench or the like for securely fastening the fastener to the shoe sole. While the present exemplary embodiment of the fastener 926 is threaded, other types of fasteners applicable for the intended use are permitted, e.g., J-lock or friction-fit fasteners and the like. According to an aspect, the fastener 926 carries the ball and socket joint 928 at its distal end.

Figure 13:
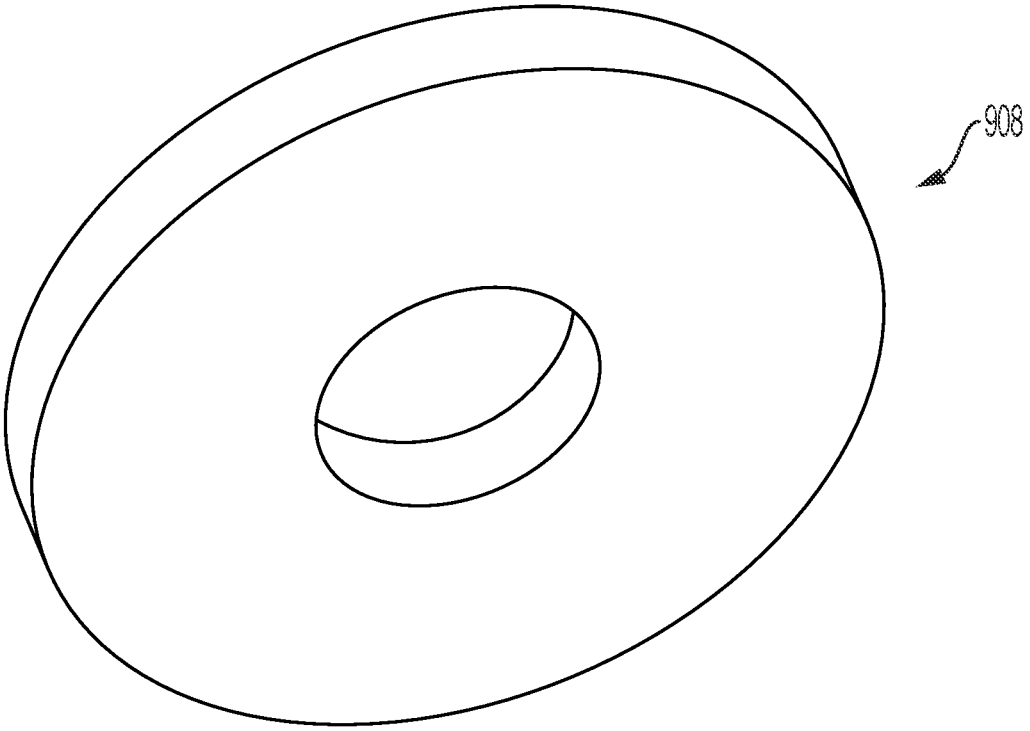
FIG. 13 is a perspective view of a first biasing member of the cleat assembly of FIG. 9.
Figure 14A:
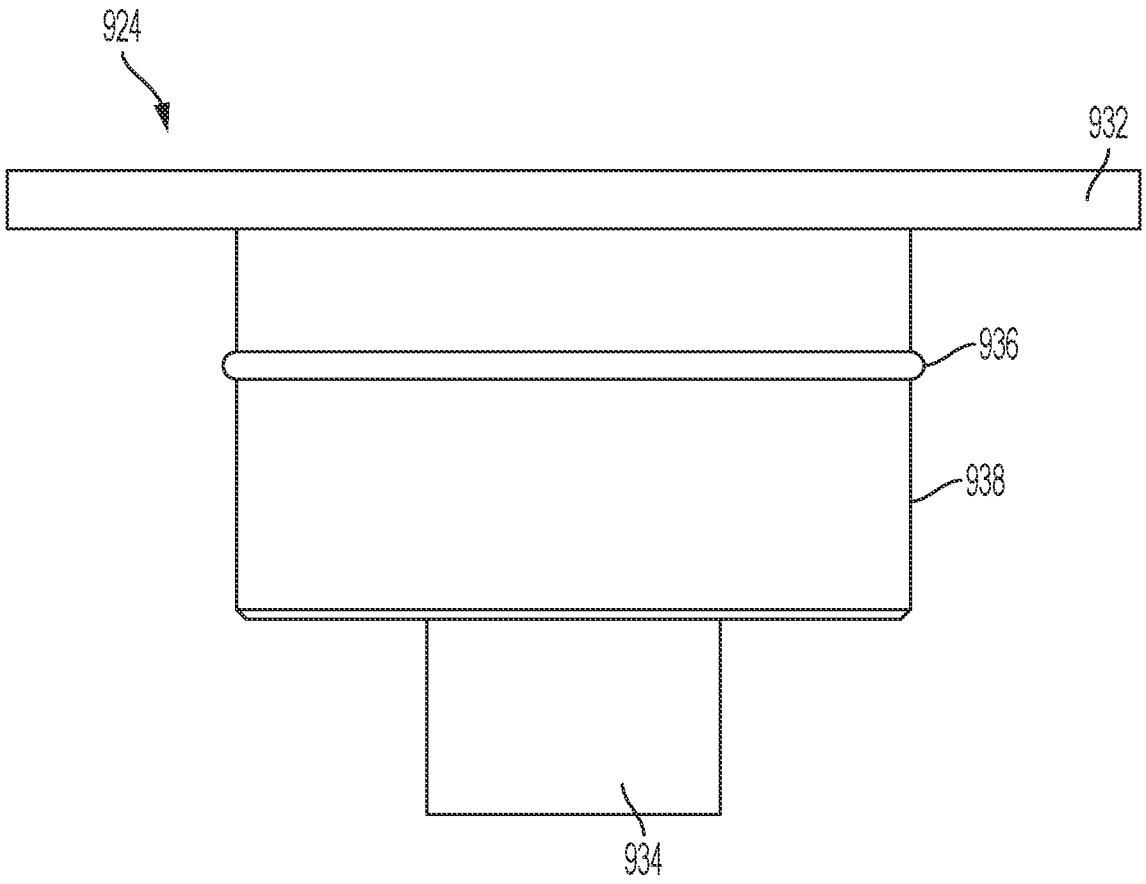
FIG. 14A is a side view of a retaining post of an anchor of the cleat assembly of FIG. 9.
Figure 14B:
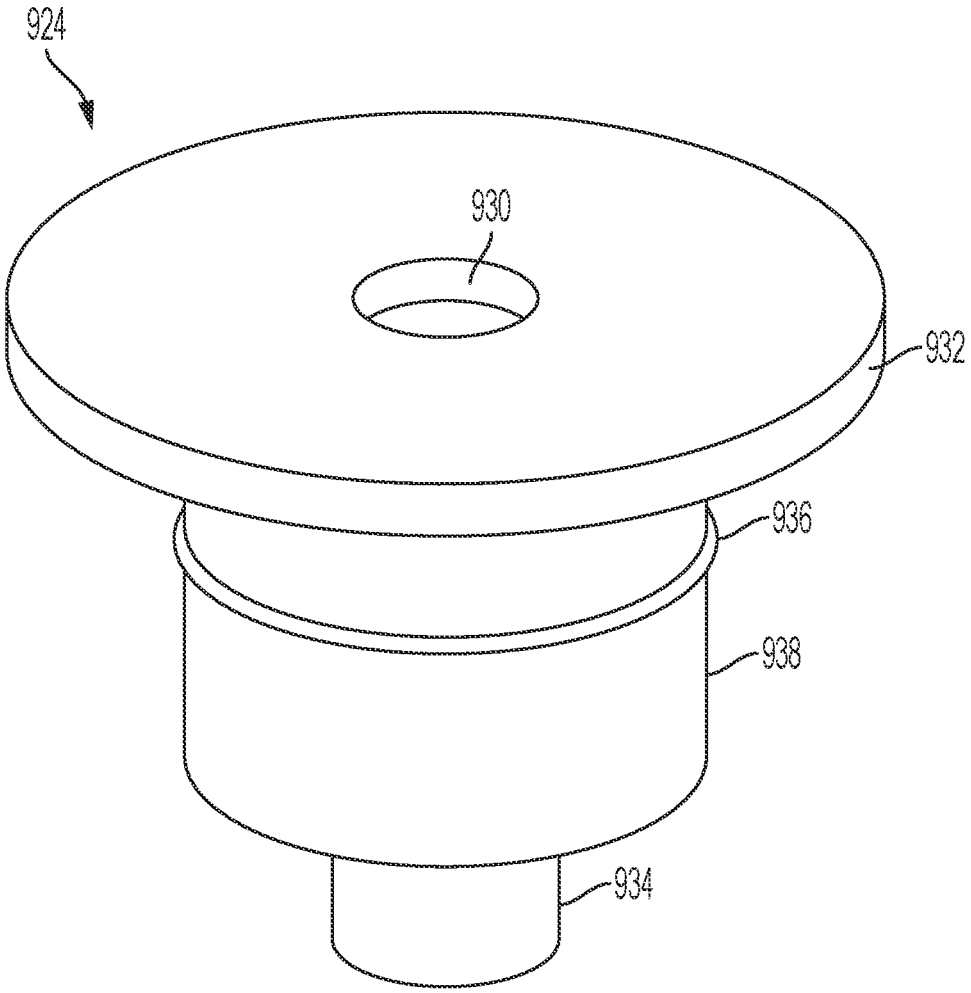
FIG. 14B is a top perspective view of the retaining post of FIG. 14A.

FIGS. 9 and 10 further show that the first biasing member 908 circumscribes the fastener 926. According to an aspect, the first biasing member can be connected to the annular flange 932 of the retaining post 924 or to the sole 904 of the shoe 905, e.g., by adhesives or other suitable connector mechanisms. As best shown in FIG. 13, the first biasing member is an annular biasing member. According to an aspect, the first biasing member can be formed from, e.g., an elastomer or other suitable resilient material, and have a bending stiffness coefficient of about 0.67 in-lbs/deg to 1.33 in-lbs/deg, including 0.50, 0.55, 0.60, 0.65, 0.70, 0.75, 0.80, 0.85, 0.90, 0.95, 1.00, 1.10, 1.20, 1.30, 1.40, 1.50, 1.60, 1.70, 1.80 and 1.90 in-lbs/deg. This torque versus angle relationship may be linear or non-linear.

Figure 15:
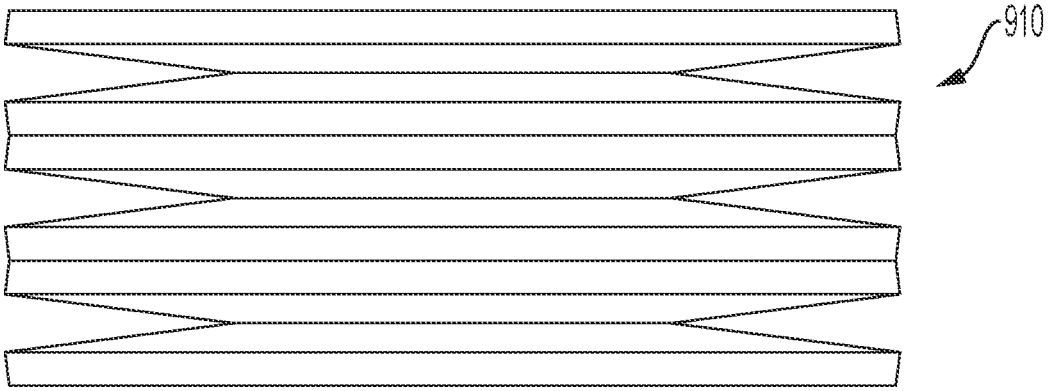
FIG. 15 is a side view of a second biasing member of the shoe cleat assembly of FIG. 9.

Referring again to FIGS. 9 and 10, the second biasing member 910 circumscribes the post 934 of the retaining post 924 and is completely housed within the cleat 906. As shown in FIGS. 9, 10 and 15, the second biasing member can be constructed as an accordion-like compression spring. However, the second biasing member may assume other forms including, without limitation, an elastomer, a polymeric member, a linear biasing member, or a non-linear biasing member, which may be annular in shape or non-annular, e.g., linear, square, hexagonal, and the like. According to an aspect, the second biasing member 910 has a spring constant from about 160 lbs/in to 250 lbs/in, including 140, 145, 150, 155, 160, 165, 170, 175, 180, 185, 190, 195, 200, 205, 210, 215, 220, 225, 230, 235, 240, 245, 250, 260, 265, 270 and 275 lbs/in.

Referring back to FIG. 9, the cleat 906 of the cleat assembly 900 is shown in an undeflected state, whereby the first biasing member 908 is not biased or compressed by the retaining post 924 or the flange 932. In contrast, FIG. 10 shows the cleat of the cleat assembly in a deflected state such as when a user is in the midst of a change in direction while running. In this state, the first biasing member 908 is compressed or biased along a side thereof by the retaining post 924 and the flange 932. Simultaneously, the first biasing member exerts a bending biasing force against the retaining post 924 and the flange 932 which operates to return the cleat to the undeflected state when the user ceases to exert deflecting force against the cleat.

It will be appreciated by those skilled in the art that changes could be made to the exemplary embodiments described above without departing from the broad inventive concept thereof. It is to be understood, therefore, that this disclosure is not limited to the particular embodiments disclosed, but it is intended to cover modifications within the spirit and scope of the subject disclosure as defined by the appended claims.

We claim:

1. A cleat assembly for a shoe comprising:
an anchor for anchoring to the shoe;
a cleat;
a first biasing member circumscribing the anchor and engaged with the cleat; and
a second biasing member biasing the first biasing member.

2. The cleat assembly of claim 1, wherein the anchor comprises:
a main body;
a fastener extending from a proximal end of the main body; and
a substantially planar bottom about a distal end of the main body, wherein the substantially planar bottom extends radially outwardly from the main body.

3. The cleat assembly of claim 2, wherein the substantially planar bottom is completely housed within the cleat.

4. The cleat assembly of claim 1, wherein the cleat circumscribes the anchor, the first biasing member, and the second biasing member.

5. The cleat assembly of claim 1, wherein the cleat includes an inner race for receiving the first biasing member.

6. The cleat assembly of claim 5, wherein the first biasing member is press-fittingly engaged with the inner race.

7. The cleat assembly of claim 1, further comprising a bushing circumscribing the anchor.

8. The cleat assembly of claim 7, wherein the bushing slidingly engages the anchor.

9. The cleat assembly of claim 7, wherein the first biasing member circumscribes the bushing.

10. The cleat assembly of claim 7, wherein the first biasing member is connected to the bushing.

11. The cleat assembly of claim 1, wherein the first biasing member is an annular biasing member.

12. The cleat assembly of claim 1, wherein the first biasing member is completely housed within the cleat.

13. The cleat assembly of claim 1, wherein the first biasing member has a bending stiffness coefficient of about 0.67 in-lbs/deg to 1.33 in-lbs/deg.

14. The cleat assembly of claim 1, wherein the first biasing member provides a bending force independent of the second biasing member providing a biasing force along an axial direction of the anchor.

15. The cleat assembly of claim 1, wherein the second biasing member directly engages the first biasing member.

16. The cleat assembly of claim 7, wherein the second biasing member directly engages the bushing.

17. The cleat assembly of claim 1, wherein the second biasing member circumscribes the anchor.

18. The cleat assembly of claim 1, wherein the second biasing member has a spring constant from about 571 lbs/in to 1143 lbs/in.

19. The cleat assembly of claim 1, wherein the anchor, the first biasing member, and the second biasing member are housed within the cleat.

20. The cleat assembly of claim 1, wherein the first biasing member is an elastomer and the second biasing member is a spring.

21. A shoe having a sole and the cleat assembly according to claim 1 secured to the sole.

22. The cleat assembly of claim 1, further comprising a shroud extending from the cleat.

23. The cleat assembly of claim 1, further comprising a deformable member between the cleat and a fastener of the anchor for preventing or expelling debris away from the cleat assembly.

24. The cleat assembly of claim 23, wherein the deformable member is a shroud, an expandable elastomer, a bellows, and/or a seal.

* * * * *